US005080497A

United States Patent [19]

Peppiatt

[11] Patent Number: 5,080,497

[45] Date of Patent: Jan. 14, 1992

[54] BAG WITH A SQUARE END AND A HANDLE

[75] Inventor: Harry R. Peppiatt, Doylestown, Pa.

[73] Assignee: Paramount Packaging Corporation, Chalfont, Pa.

[21] Appl. No.: 533,434

[22] Filed: Jun. 5, 1990

[51] Int. Cl.[5] ..... B65D 33/10

[52] U.S. Cl. ..... 383/21; 383/8; 383/9; 383/66

[58] Field of Search ..... 383/8, 9, 17, 21, 24, 383/29, 66, 67, 121

[56] References Cited

U.S. PATENT DOCUMENTS

| | | | |
|---|---|---|---|
| 3,375,969 | 4/1968 | Davis, Jr. . | |
| 3,395,622 | 8/1968 | Kugler . | |
| 3,460,441 | 8/1969 | Davis, Jr. . | |
| 3,470,795 | 10/1969 | Davis, Jr. . | |
| 3,519,197 | 7/1970 | Campbell | 383/66 X |
| 3,534,520 | 10/1970 | Moran . | |
| 3,534,665 | 10/1970 | Davis, Jr. . | |
| 3,534,666 | 10/1970 | Maccherone . | |
| 3,537,360 | 11/1970 | Farnam . | |
| 3,555,974 | 1/1971 | Davis, Jr. . | |
| 3,567,110 | 3/1971 | Susuki et al. | 383/17 X |
| 3,599,538 | 8/1971 | Piazze . | |
| 3,654,841 | 4/1972 | Davis, Jr. . | |
| 3,690,545 | 9/1972 | Piazze . | |
| 3,739,694 | 6/1973 | Davis, Jr. . | |
| 3,802,308 | 4/1974 | Davis, Jr. . | |
| 4,524,459 | 6/1985 | Titchenal . | |
| 4,573,203 | 2/1986 | Peppiatt . | |
| 4,759,642 | 7/1988 | Van Erden et al. . | |
| 4,769,125 | 9/1988 | Roen et al. | 383/9 X |
| 4,877,336 | 10/1989 | Peppiatt . | |
| 4,934,535 | 6/1990 | Muckenfuhs et al. | 383/8 X |

FOREIGN PATENT DOCUMENTS

| | | | |
|---|---|---|---|
| 2811219 | 9/1979 | Fed. Rep. of Germany | 383/21 |
| 3634238 | 4/1988 | Fed. Rep. of Germany | 383/29 |

*Primary Examiner*—Stephen P. Garbe
*Assistant Examiner*—Jes F. Pascua
*Attorney, Agent, or Firm*—Fitzpatrick, Cella, Harper & Scinto

[57] ABSTRACT

A bag having a handle includes a front, a rear, and an end wall of flexible plastic, and is capable of being manufactured at high speed by automatic machinery. Left and right side walls of flexible plastic are provided, each side wall having a Y-shaped seam so that the bag assumes a cubic or hexahedral shape when filled. A flexible plastic handle is provided and bridges at least a portion of a rectangular end wall. Preferably, structure is provided for gaining access to the bag interior, and the plastic portions joined at the Y-shaped seams are substantially co-planar with no plastic overlap. The bag may be manufactured by folding a first flexible plastic sheet over on itself and then making an interior fold at the folded portion to provide a M-shaped cross section at one bag end. A second flexible plastic sheet is folded over on itself and affixed to the bag so as to span at least a portion of the first plastic sheet bag end having the M-shaped fold therein. The bag is then trimmed and sealed to eliminate left and right corner portions of the M-shaped fold and the second plastic sheet at the one bag end. Also, left and right side edges of the bag are sealed and trimmed so that the bag assumes a substantially cubic or hexahedral shape when filled. The second plastic sheet is also trimmed to form a handle.

12 Claims, 5 Drawing Sheets

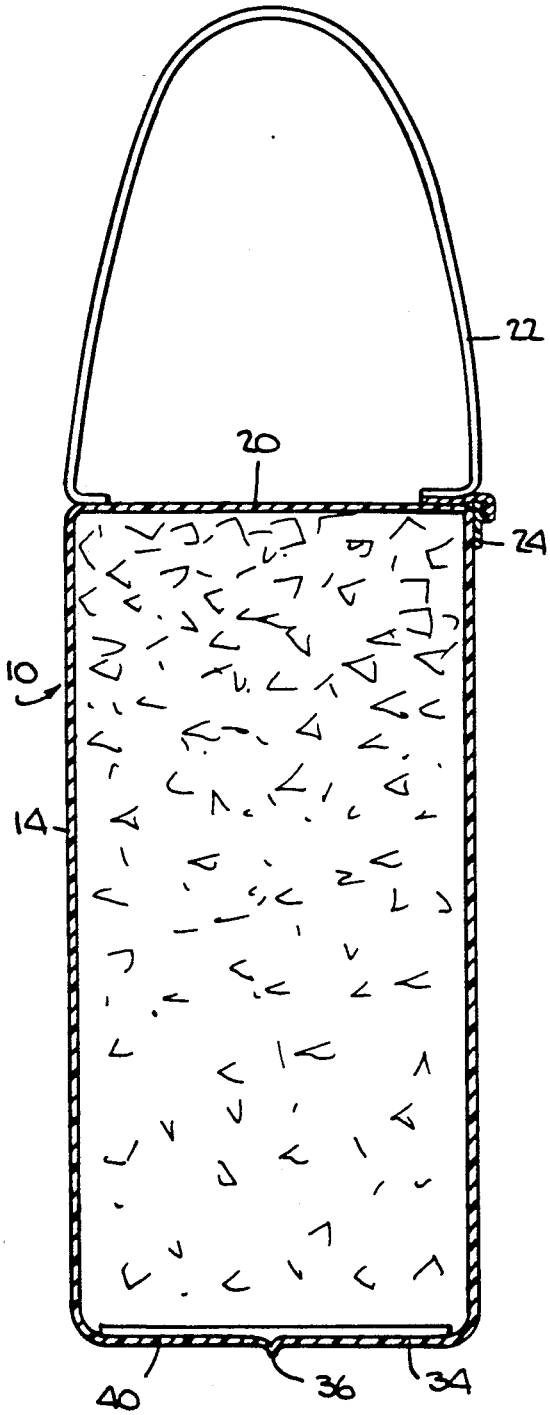
Fig. 3.
Fig. 4.
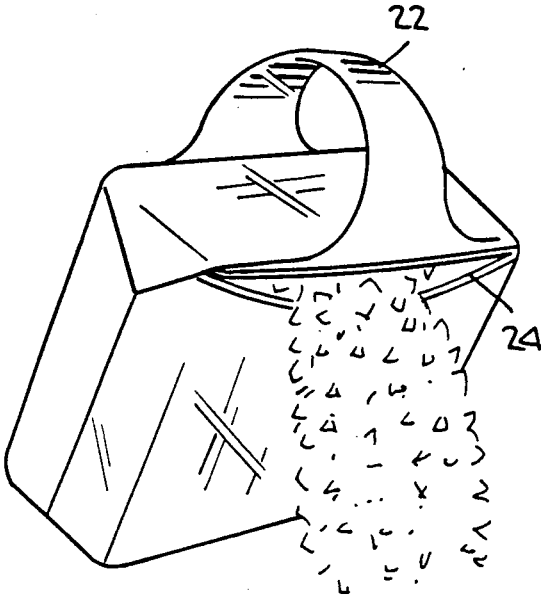
Fig. 9.
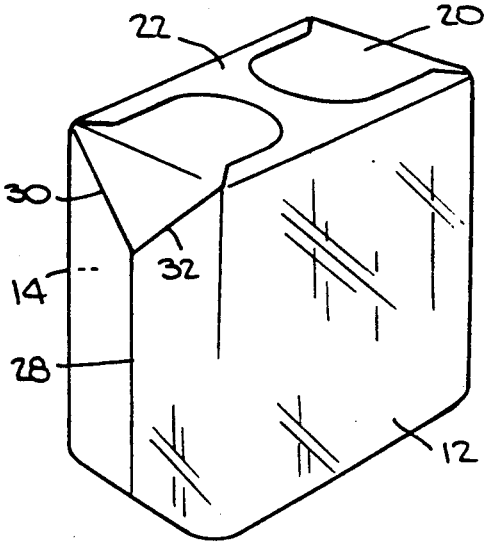

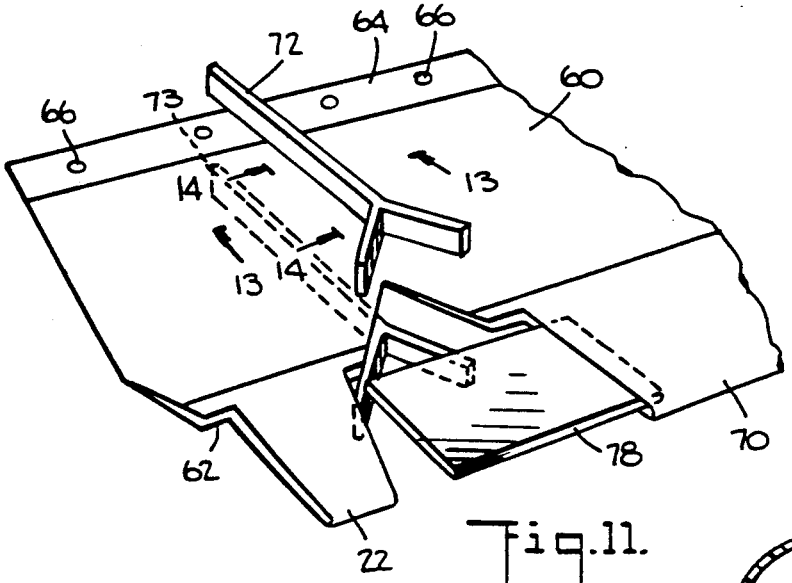
Fig. 11.
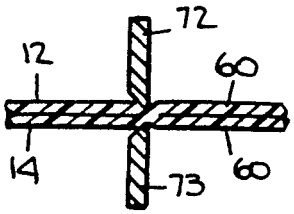
Fig. 13.
Fig. 5.
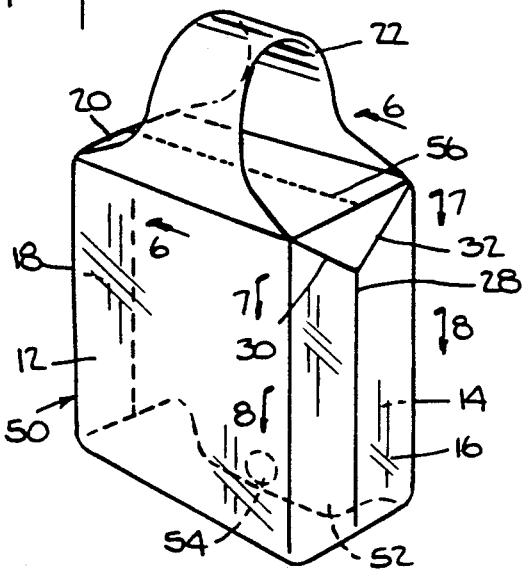
Fig. 6.
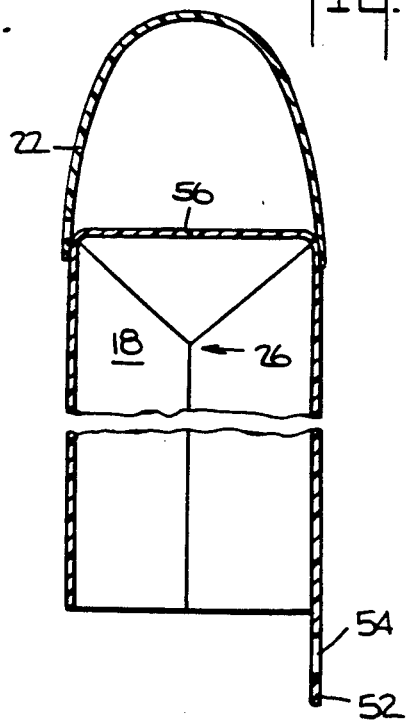
Fig. 7.
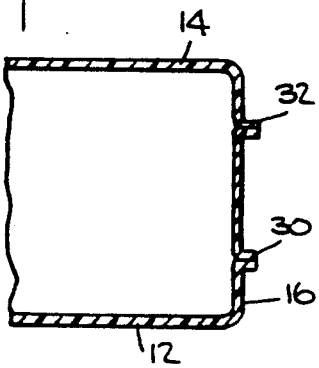
Fig. 8.
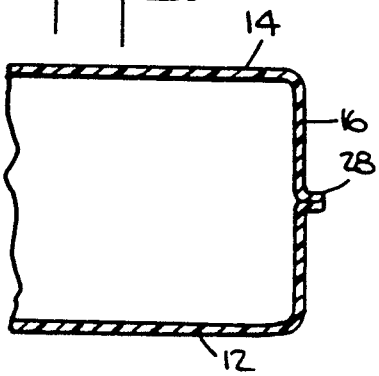

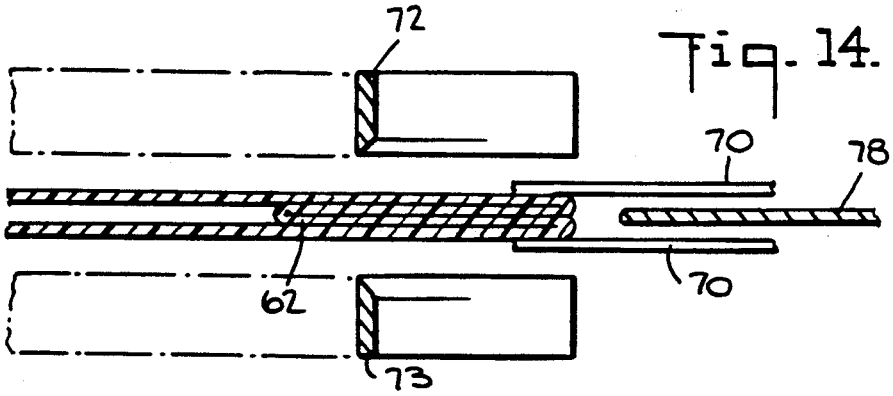
Fig. 14.
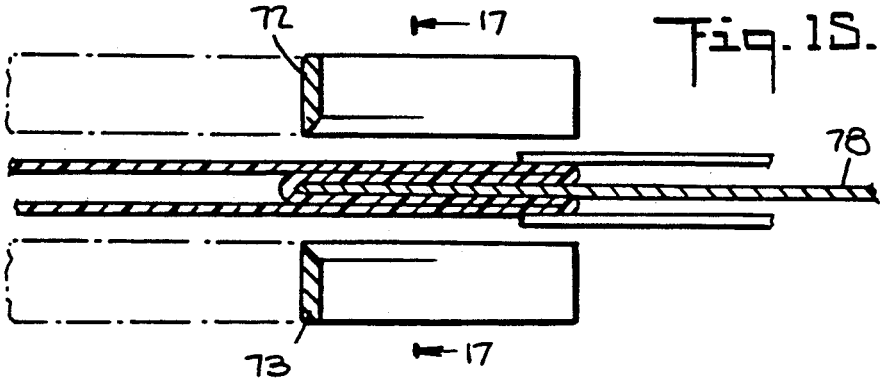
Fig. 15.
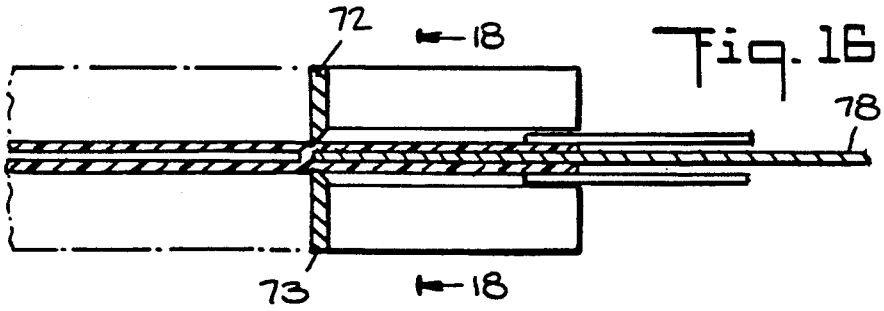
Fig. 16.
Fig. 17.
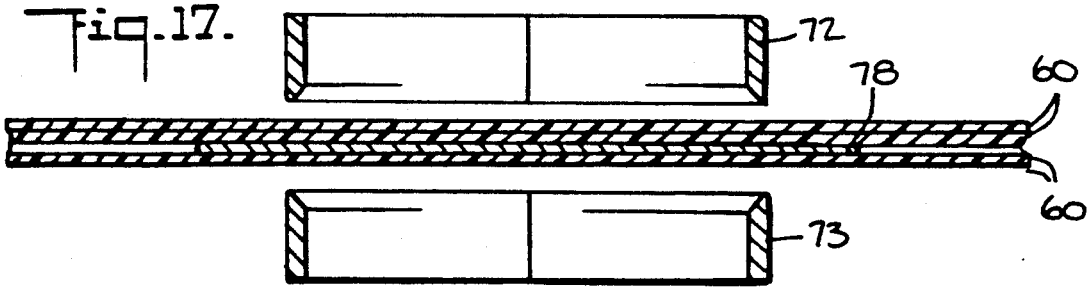
Fig. 18.
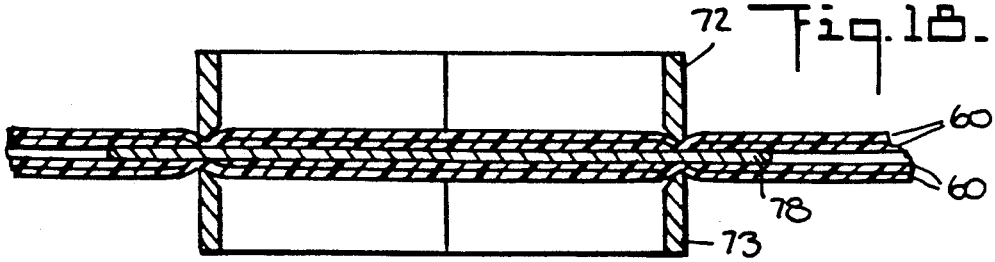

BAG WITH A SQUARE END AND A HANDLE

SCOPE OF THE INVENTION

The present invention relates to a bag that is capable of being manufactured at high-speed by automated machinery and which has a substantially cubic or hexahedral shape when filled, and a handle spanning one rectangular end. The present invention also relates to a method for making such a bag.

BACKGROUND OF THE INVENTION

Collapsible bags made from sheets of flexible thermal plastic are known for storing, shipping, and dispensing products such as disposable diapers, etc. Such bags preferably include a handle for carrying the product and an opening for providing access to the interior of the bag.

It is highly desirable that such bags assume a cubic or block shape when filled and used. In transit, such shapes can be stacked together compactly without unused, wasted space. On the store shelf, such shapes stack better and display their graphics better. After purchase, these shapes stand upright in the customer's closet or on the customer's shelf.

Achieving and tending to maintain a cubic or block shape is particularly difficult, however, with flexible thermal plastic sheeting, which does not tend to hold any solid shape. Thin flexible plastic sheeting has the desirable features of economy and ease of manufacture in high-speed, automatic machinery, but the thinness and flexibility, which make it desirable in those respects, prevent it from easily achieving and maintaining the desired cubic or block shape.

Handles are also a desirable feature on such bags. In the prior art, some handles, as a consequence of high-speed automatic manufacture, have extended around the entire perimeter of these bags, or have extended between their narrow ends. The use of such handles (for example, the handle disclosed in U.S. Pat. No. 4,550,439, "Plastic Bag with Carrying Handle," invented by H. R. Peppiatt and John S. Thomas) has tended to destroy the desired shape, particularly when the bag is partially empty. Because of lifting forces transmitted to the ends of such bags, they have a tendency to distort and yawn open when carried.

An additional complication in the use and manufacture of such bags is the recent trend toward compacting soft products, such as disposable diapers, before placing them in plastic bags for distribution. Compressing such products before inserting them into plastic carrying bags minimizes the space required by the plastic bag and its contents. Compressed products, however, may be more difficult to insert into the bag.

At present, however, plastic bags manufactured on high speed machinery in continuous processes may include tucks, folds and substantial overlapping of excess plastic. These tucks, etc. may make it difficult to insert product, particularly compressed product, and also may make the bag lumpy and unsightly for display purposes.

The present invention, however, provides a cubic or block shape for the bag and a handle which allows easy transportation of such a bag. Moreover, because the carrying loads are distributed essentially only along the front and back walls of the bag, the handle of the present invention tends to provide and maintain the cubic or block shape and to provide smooth sides, even when the bag is partially empty. The present invention also provides a mass production technique for fabricating such a bag.

In addition, the structure of the present invention provides good characteristics for pourability of granular, powder, or pelletized products.

A further problem solved by the present invention is that of providing smooth and easy access to the interior of such a bag for both filling and removal of product.

These advantages are discussed in detail below. Additional ones will be apparent to those skilled in the art from the following description.

SUMMARY OF THE INVENTION

The present invention relates to a collapsible plastic bag having a handle and one or more Y-shaped seams along its sides so that the bag assumes a substantially hexahedral or parallelepiped shape when filled.

According to one aspect of the present invention, a bag having a handle includes a front, a rear, and an end wall of flexible plastic. Left and right side walls of flexible plastic are provided, each side wall having a Y-shaped seam therein. The base portion of each Y-shaped seam joins together plastic from the front and rear walls. One arm portion of each Y-shaped seam joins together plastic from the front wall and the end wall, and the other arm portion of each Y-shaped seam joins together plastic from the rear wall and the end wall. A flexible plastic handle spans at least a portion of the end wall and extends from an arm portion of one seam to an arm portion of the other seam. Preferably, all portions of the flexible plastic which are joined at the seams are substantially co-planar without substantial overlap of the plastic sheet. Preferably, the handle is coupled to the rest of the structure at or near the junctions of the end wall with the front and rear walls. Most preferably, when a resealable opening is formed in the bag, the handle is coupled to the end wall.

According to a further aspect of the present invention, a plurality of bag structures, manufacturable by high speed automated machinery from two extended sheets of flexible thermal plastic, comprises a plurality of upper and lower trapezoidal-shaped pieces of flexible plastic sheet, each integral at its shorter parallel side with a hexagonal piece of flexible plastic sheet and at its longer parallel side with upper and lower rectangular pieces of flexible plastic, respectively. The side edges of the upper and lower rectangular pieces of plastic are affixed to each other, and the diagonal edges of the trapezoidal-shaped pieces are affixed to the hexagonal piece. Handles, preferably manufactured from a single extended sheet of plastic, are provided and extend across at least a portion of the hexagonal piece and between the diagonal edges. Preferably, the handle is coupled to the rest of the structure at or near the junction of the shorter parallel sides of the trapezoidal shaped pieces and the hexagonal piece.

The present invention also includes a method for manufacturing such a bag. A preferred method comprises the steps of folding a first flexible plastic sheet over on itself and then making an interior fold at the folded portion to provide a M-shaped cross section at one bag end. A second flexible plastic sheet is folded over on itself and each edge thereof is affixed to the first plastic sheet so that its spans at least a portion of the first plastic sheet at the one bag end. The bag is then trimmed and sealed to eliminate left and right corner portions of the M-shaped fold and the second plastic sheet at the one bag end. The left and right side edges of the bag are sealed as well as the edges of the trimmed portions of the M-shaped fold at the one bag end. The second plastic sheet is trimmed to form the handle.

A further preferred process according to the method of the present invention produces a plurality of flexible plastic bags with handles and comprises the steps of folding a first plastic sheet over on itself, the fold being parallel to a longitudinal axis of the first plastic sheet. An interior fold is made in the first plastic sheet at the above-mentioned fold to provide an M-shaped fold at one bag end. A second plastic sheet is folded over on itself along a longitudinal axis thereof, and two edges thereof are fixed to surfaces of the first plastic sheet so that the folded second plastic sheet bridges the M-shaped fold of the first plastic sheet. Portions of the second plastic sheet are cut away to provide a plurality of handles, each one coupled to a respective bag. A plurality of cutting and sealing steps are performed whereby a left side edge of a first bag and a right side edge of a second bag are cut and sealed along a line substantially perpendicular to the longitudinal axis. Also, a left corner portion of the M-shaped fold of the first bag and a right corner portion of the M-shaped fold of a second bag are cut and sealed along diagonal lines which form angles with both the longitudinal axis and a line substantially perpendicular thereto. Preferably, this method simultaneously cuts and seals the left and right edges and the left and right corner portions of adjacent bags in order to provide a plurality of collapsible plastic bags each having a rectangular shaped end and a handle.

BRIEF DESCRIPTION OF THE DRAWINGS

For the purpose of illustrating the invention, the drawings show preferred forms, but this invention is not limited to the precise arrangements and instrumentalities pictured or described.

FIG. 3 is a cross-sectional view of a second embodiment of the present invention.

FIG. 4 is a perspective view of the bag shown in FIG. 3 showing product being poured from an opening in the bag.

FIG. 5 is a perspective view of a third embodiment of the present invention.

FIG. 6 is a cross-sectional view of the bag shown in FIG. 5 taken generally along sectional lines 6—6.

FIG. 7 is a partial, cross-sectional view of the FIG. 5 bag taken generally along sectional lines 7—7.

FIG. 8 is a partial, cross-sectional view of the FIG. 5 bag taken generally along sectional lines 8—8.

FIG. 9 is a perspective view of a fourth embodiment of the present invention.

FIG. 11 is a perspective view showing a part of the process of manufacturing a plurality of bags according to FIG. 1.

FIG. 13 is a cross-sectional view generally taken generally along lines 13—13 of FIG. 11.

FIGS. 14, 15, and 16 are cross-sectional views generally taken along sectional line 14—14 of FIG. 11, depicting the process of simultaneously sealing and cutting bag edges.

FIGS. 17 and 18 are cross-sectional views taken generally along sectional line 17—17, and 18—18, of FIGS. 15 and 16, respectively.

DETAILED DESCRIPTION OF THE PREFERRED EMBODIMENTS

A bag and handle according to the present invention may be manufactured by automated high speed machinery from two extended sheets of flexible thermal plastic. The bag includes a handle and at least one bag end which is substantially cubic or parallelepiped-shaped when filled. The invention allows for transportation convenience while permitting the maximum interior volume in a bag having minimal exterior dimensions. This means that a very small amount of plastic is used to package, transport, handle, and use products such as disposable diapers. At the same time the invention tends to establish a rectangular or square shape with smooth sides when filled, when carried, and during use. There are also significant advantages of accessibility and pourability.

Figure 1:
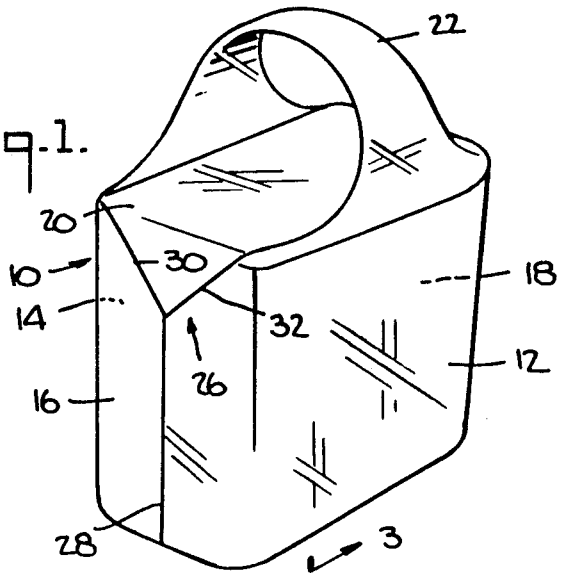
FIG. 1 is a perspective view of a first embodiment of the present invention.

FIG. 1 is a perspective view of a first embodiment wherein bag 10 includes a front web or wall 12, a rear wall 14, side walls 16 and 18, and a top or end wall 20. A flexible plastic handle 22 extends across end wall 20 and may be affixed to the front and rear walls 12 and 14, preferably at or near the junction of the front and rear walls with end wall 20. Alternatively, handle 22 may be coupled to the end wall 20, or to a combination of the front, rear, and end walls. The use for which a particular bag is designed will determine the location and size of the handle.

The bag depicted in FIG. 1 has a rectangular-shaped top which assumes a substantially cubic or parallelepiped shape when the bag is filled. This is achieved by providing a Y-shaped seam 26 in each of the bag sides 16 and 18. Each Y-shaped seam 26 includes a base portion 28, and two arm portions 30 and 32, respectively. The base portion 28 joins together the plastic sheets which comprise the front wall 12 and the rear wall 14. Arm portion 32 joins together plastic which comprises the front wall 12 and the end wall 20, while arm portion 30 joins together plastic which comprises the rear wall 14 and the end wall 20. Thus, end wall 20 comprises a substantially hexagonal-shaped plastic sheet coupled to the front and rear walls 12 and 14 along arm portions 30 and 32 of the Y-shaped seams 26. Each of the front and rear walls 12 and 14 thus comprises a plastic sheet having a trapezoidal upper portion and a rectangular lower portion.

One lower edge of handle portion 22 extends from one arm portion 32 on side 16 near the top of front wall 12 to the opposing arm portion (not shown) on side 18. The other lower edge of handle portion 22 extends from arm portion 30 on side 16 near the top of wall 14 to the opposing arm portion (not shown) on side 18. The handle portion is thus preferably attached principally to or near the front wall 12 and rear wall 14. Little or no lifting forces are transmitted directly to end walls 16 and 18. In this arrangement, when the bag is lifted, the pull of the handle is highly functional. The forces are directed principally down the longer front and rear walls. This tends to maintain the rectangular shape and provide smooth front and rear walls. Moreover, since no excess plastic extends completely around the perimeter, the bag is uncluttered without sacrificing strength while still being capable of high-speed manufacture.

As will be described later, a method of manufacturing such a bag utilizes a first extended sheet of flexible thermal plastic for the bag itself, and a second such sheet for the handle. Specifically, the first plastic sheet is folded at one end thereof to provide an M-shaped cross-section. Then, diagonal portions of the M-shaped fold are trimmed and sealed to provide Y-shaped seams when the bag is filled. By thus using a single sheet of plastic, the bag can be quickly and conveniently manufactured continuously on automated machinery and utilizes the minimum amount of plastic.

Figure 2:
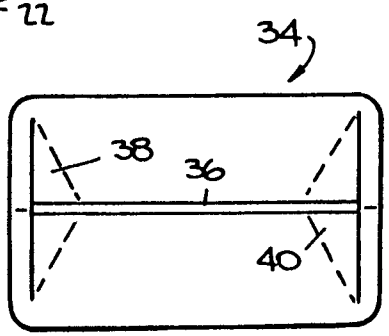
FIG. 2 is a bottom plan view of the bag shown in FIG. 1.

FIG. 2 shows a bottom 34 of the FIG. 1 bag. In this embodiment, bottom 34 is closed after product is inserted into the bag and assumes a substantially cubic or parallelepiped-shaped structure when filled by virtue of a bottom seal 36 and gusseted portions 38 and 40, as are known in the art. Thus, in use, the bag according to FIG. 1 can be manufactured leaving the bag bottom open. Such a bag can be provided to a supplier who will fill the bag and then seal it at the bottom using well-known techniques.

FIG. 3 is a cross-sectional view of a second embodiment of the present invention in which a resealable closure 24 is confined to a single side of the hexahedral bag. Even though the bag may be manufactured by high-speed techniques, the resealable opening 24 does not extend around a corner between front wall 12 and end walls 16 or 18. The resealable closure is preferably disposed at the boundary between the front wall 12 and the end wall 20, though it may be located anywhere on the bag (for example, on end wall 20). The edges of handle 22 are fixed to the end wall 20 and/or to a portion of the closure which is fixed to the end wall 20. It can be seen that the bag assumes a generally rectangular shape wherein the front and rear walls 12 and 14 are substantially parallel, as are the end and bottom walls 20 and 34 and the side walls 16 and 18 (a parallelepiped shape). The handle 22 is shown affixed to the end wall 20 and to the portion of the closure positioned on the end wall such that the handle extends across the end wall 20. The bag depicted in FIG. 3 shows the resealable closure 24 which permits access to the interior of the bag. In a preferred embodiment, the closure 24 comprises a tongue-in-groove, flexible plastic structure known in the art. Of course, any alternative closure structures may be used such as folded flaps, zippers, VELCRO TM (Tm), etc. The closure 24 is at the top of front wall 12 with the opening at the 90 degree angle between the front wall 12 and the end wall 20. This greatly simplifies the pouring of a product from the bag. It can also be seen that the product within the bag of FIG. 3 will also form a substantially rectangular shape, thus making the product more stackable for more compact transportation of large quantities of product.

FIG. 4 is a perspective view of the FIG. 3 bag showing product being poured through closure 24. To pour from the bag, the handle 22 is gripped and the closure 24 is opened. The bag can then be pivoted about handle 22 by lifting up on the bag bottom, thus expelling product from the bag. This structure provides a very convenient handling method. The FIG. 3 bag having a resealable closure 24 is also advantageous for non-pourable products such as disposable diapers. The bag can be resealed after removing a diaper thus insuring the cleanliness of the remaining diapers. Further, since the bag is resealable, it may be used for other functions after the product has been entirely consumed.

The closure 24 and its opening are thus preferably located at a top edge of the bag on a corner between the front and end wall. This results in an opening which has remarkably good features. It can open wide for easy access to the contents. When pouring granular products, the opening functions well as a spout. The opening of this invention, when closed, does not greatly harm the rectangular shape of the bag, since the opening is essentially on the corner, and the bag and its contents have good handleability characteristics notwithstanding the opening. Of course, the closure 24 and its opening could be located in any one or more of the front, side and end walls, depending on the intended use. Nevertheless, placing the closure at the corner between the front and end walls provides an opening which forms a natural channel for pouring product from the bag. Further, such a location assures that all of the product will leave the bag, and provides a very handy structure for the user.

FIGS. 5–8 depict a third embodiment according to the present invention. Elements similar to those in the first two embodiments are depicted with the same reference numerals. Bag 50 includes front wall 12, rear wall 14, and end wall 20. Handle 22 straddles end wall 20, as in the first embodiment, but is affixed to the front and rear walls 12, 14 rather than the end wall 20. Y-shaped seams 26 are disposed on both of the side walls 16 and 18. Thus, the bag of FIG. 5 also assumes a cubic or parallelepiped-like shape when the bag is filled.

The bag according to FIG. 5 is open at the bottom with an extension 52 extending downward from rear wall 14. One or more holes 54 are located in the downward extension 52. This construction allows a bag to be produced according to the present invention and provided to a supplier who will load product into the bag through the opening in the bottom. The hole or holes 54 may be used by such a supplier to support the bag while loading it with product. Upon completion of loading, the supplier may seal the bottom bag, as is depicted in FIG. 2.

Rather than a resealable opening 24, the bag according to FIG. 5 has linear perforations 56 extending across the top panel of end wall 20 to allow access to the bag interior. Such perforations may be used, for example, with certain disposable diapers where resealing the bag between uses is not a requirement. The perforations may extend down the side panel of end wall 20 to the seam portion 28, but this may create an unacceptable stress point at this location. It is, therefore, preferred to distance perforations 56 from the junction of the bag seams 28, 30 and 32. Alternatively, it may be preferred to use perforations of a curvilinear design, such as a semi-circle or a full circle, in the front wall 12 or elsewhere on the bag.

FIG. 6 is a cross-sectional view of the FIG. 5 taken generally along sectional lines 6—6. The extension 52 is depicted as extending below rear wall 14 and projecting beyond the end of front wall 12. Hole 54 is located in extension 52 below the opening in the bottom of the bag.

In this embodiment, the edges of handle 22 are affixed to the outside surfaces of front wall 12 and rear wall 14, respectively. This handle configuration is generally similar to that depicted in FIG. 1. However, affixing handle 22 to any convenient location in the vicinity of end wall 20 comprises part of this invention. Specifically, the edges of handle 22 may be coupled to the end wall 20, or one edge may be coupled to the end wall while the other edge is coupled to one of the front or rear walls or to a portion of closure 24. Again, the use to which the bag is put will dictate the specific handle structure.

FIG. 7 is a partial cross-sectional view of the FIG. 5 bag taken along sectional lines 7—7. In FIG. 7, arm portions 30 and 32 of seam 26 are depicted as connecting front wall 12 to end wall 20, and rear wall 14 to end wall 20, respectively. Although the seams in FIG. 7 are shown in enlarged form, where the plastic portions are connected they may be substantially co-planar with minimal overlap at seam portions 30 and 32 and essentially no tucks or bunching of excess plastic. In fact, the overlap of plastic at the seam portions 30 and 32 may be approximately one millimeter or less, extending orthogonally to side wall 16. Those of skill in the field can appreciate the substantial packaging advantages to be achieved by forming a plastic bag with so little excess plastic.

FIG. 8 is a partial cross-sectional view of the FIG. 5 bag taken along sectional lines 8—8. In this view, the base portion 28 of seam 26 is clearly depicted. Seam portion 28 joins together plastic from front wall 12 and rear wall 14. Again, these plastic portions are substantially co-planar with substantially no overlap at the seam portion 28. Again, the plastic overlap amounts to approximately one millimeter or less extending orthogonally to side wall 16.

FIG. 9 depicts a fourth embodiment according to the present invention wherein the handle 22 is affixed to the end wall 20 rather than the front and rear walls 12 and 14. Also in this embodiment, handle 22 is made substantially shorter than the handle of the FIG. 1 and FIG. 5 embodiments. In use, the handle 22 is much closer to the end wall 20, thus reducing the amount of plastic required in a collapsible bag. Using the present invention, a variety of handles may be attached during high-speed manufacturing.

Figure 10:
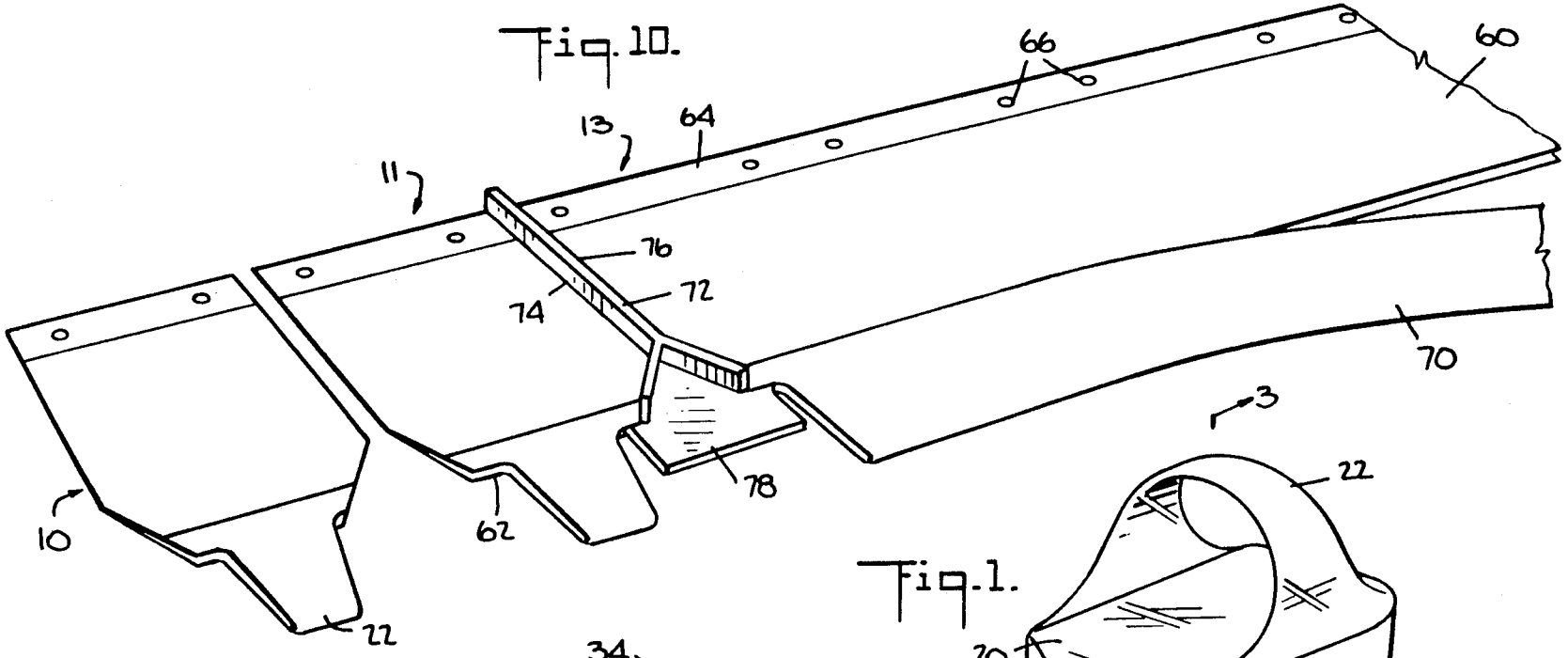
FIG. 10 is a perspective view of a plurality of FIG. 1 bags according to a preferred method of producing such bags.

FIG. 10 depicts a process for manufacturing the bag according to the FIG. 1 embodiment. In FIG. 10, a first extended, continuous thermal plastic sheet 60 is folded over on itself along its longitudinal axis. An M-shaped inward fold 62 is made at the folded end. A second extended, continuous sheet of thermal plastic 70 is folded over on itself along its longitudinal axis and is positioned with respect to the first plastic sheet 60 so as to bridge the M-shaped fold 62.

The thus-positioned and folded plastic sheets 60 and 70 are subjected to a continuous trimming and sealing procedure, which may be done at high speed using automatic machinery, whereby individual bags 10, 11 and 13 are produced. Specifically, second plastic sheet 70 is affixed to first plastic sheet 60, and portions of second plastic sheet 70 are trimmed away with, e.g., a hot wire or Y-shaped tool 72 to produce the handle 22. Also, left and right side edges of the bags 11, 13 are trimmed and sealed at 74, 76 to produce the individual bags, as will be discussed below. Thus, the structure of the bag according to the FIG. 1 embodiment is particularly designed for mass production techniques where a plurality of bags are produced continuously and sequentially.

FIG. 11 depicts a close-up view of the process whereby the plastic sheets are formed, sealed, and trimmed to produce the individual bags. Referring to FIG. 10 and 11, first plastic sheet 60 is folded over upon itself, and again folded at inward fold 62 to create the M-shaped bag end. Note that a portion 64 of first plastic sheet 60 is arranged to extend beyond the bag bottom. Holes 66 are formed in the extension 64 to be used in filling, as noted above with respect to the FIG. 5 embodiment.

Second plastic sheet 70 is then positioned with respect to the first plastic sheet 60, as described above. The second plastic sheet 70 may be sealed by any of several techniques known in the art to the first plastic sheet 60 when it is first positioned on said first plastic sheet, or, alternatively, it may be sealed to first plastic sheet 60 immediately before or during the trimming and sealing procedure. Also, the second plastic sheet 70 may be trimmed to form the characteristic shape of handle 22 immediately after the second plastic sheet 70 is positioned with respect to first plastic sheet 60, or, alternatively, the handle may be formed during the following trimming and sealing procedure.

The thus-folded and assembled plastic sheets are subjected to a trimming and sealing procedure whereby the walls of the plastic bag are formed and the Y-shaped seams are produced. Specifically, a Y-shaped cutting and sealing tool 72 is used to cut and seal a left edge 74 of a first bag 11 and a right side edge 76 of a second bag 13. Those of skill in this field will understand that the Y-shaped tool 72 can simultaneously cut and seal the plastic sheets to produce the seam portions 28, 30, and 32 located as depicted in FIGS. 7 and 8. Alternatively, Y-shaped tool 72 may merely seal the bag edges with the cutting performed in a later step, for example by a hot-wire or knife. As another alternative, the tool 72 may be separated into two pieces, and the arm portions of the tool 72 that form the notch against blank 78 may be used in a separate step from the base portion of tool 72.

The upper arm portions of Y-shaped tool 72 are angled with respect to the longitudinal axis of the plastic sheet 60 and the base portion of the Y-shaped tool itself. These upper arm portions of the tool 72 produce diagonal lines along left and right corner portions respectively, of first and second bags 11 and 13. Thus, bag 11 comprises an upper trapezoidal-shaped structure and a lower rectangular-shaped structure. The end wall 20 is folded inside of the bag end and, when filled, the bag will present the characteristic Y-shaped seams 26 and the cubic or parallelepiped-shaped bag end. Note that the upper arm portions of the Y-shaped tool 72 also cut and seal left and right edges of the handle 22. Thus, no excess plastic from handle 22 remains.

In order to facilitate access to the interior of the bag, it may be desirable to form a slit or perforations in plastic sheet 60 at the location of closure 24. This cutting may be performed during or after the trimming and sealing procedure described above with respect to the Y-shaped tool 72. Also, in order to ease the process of filling the bag with product, vent holes (not shown) may be located in the bag e.g. in the end wall 20 or the front and rear walls 12, 14.

As may be readily appreciated, the Y-shaped tool 72 may be mirrored underneath the sheets 60 on the bag in order to effectively cut and seal seam portions 30 and 32 simultaneously. To this end, a blank 78 may be inserted into the interior fold 62 of the first plastic sheet 60 before the Y-shaped tool 72 cuts and seals the bag edges and diagonal lines. This procedure is depicted in more detail in FIG. 11.

FIG. 11 is a partial, perspective view of the trimming and sealing operation described above. As shown in FIG. 11, blank 78 is inserted into inward fold 62 to the bottom thereof before the Y-shaped tool 72 cuts and seals the bag sides and corner portions. Y-shaped tool 72 is paired with a Y-shaped tool 73 disposed below the bag. After blank 78 is inserted into the inward fold 62, the Y-shaped tools 72 and 73 are brought together to cut and seal the bag side edges and corner portions. Thus, when filled, the bag will present the characteristic Y-shaped seams 26 described earlier. As may be appreciated, the Y-shaped tools 72 and 73 may have extensions on the upward arm portions in order to cut the second plastic sheet 70 to form handles 22.

FIG. 13 is a cross-sectional view of FIG. 11 taken along sectional lines 13—13. Y-shaped tools 72 and 73 are shown sealing together portions of first plastic sheet 60 to form the front and rear walls 12 and 14. Those of skill in this field will readily appreciate that any reasonably convenient means for sealing together plastic may be used, including thermo-plastic welding, gluing, etc. Also, Y-shaped tools 72 and 73 may have structure for cutting plastic sheet 60 while simultaneously sealing together the edges thereof, or there may be reasons to perform the cutting and the sealing in separate steps. The tools 72 and 73 preferably have sharp or chisel-shaped edges to produce thin, straight seams.

FIG. 14 is a cross-sectional view of FIG. 11 taken along sectional lines 14—14. The first plastic sheet 60 has been folded over on itself and inward fold 62 has been provided in the folded end. Second plastic sheet 70 has been affixed to outer surfaces of first plastic sheet 60. The Y-shaped tools 72 and 73 have not yet cut or sealed the plastic, and blank 78 has not yet been inserted in interior fold 62. Alternatively, if properly positioned with appropriate sheet feeding, blank 78 may be fixed. The particular arrangement of the various folding, cutting and sealing elements may be varied.

In FIG. 15, blank 78 has been inserted in inward fold 62 and Y-shaped tools 72 and 73 begin to move together.

In FIG. 16, the Y-shaped tools 72 and 73 are brought together near the left-most edge of blank 78 in order to perform the sealing and/or cutting described earlier.

FIG. 17 is a cross-sectional view of FIG. 15 taken along sectional lines 17—17. Again, blank 78 has been inserted into inward fold 62 of plastic sheet 60, and the Y-shaped tools 72 and 73 are shown approaching the plastic sheet 60, but the second plastic sheet 70 is not present in this view.

FIG. 18 is a cross-sectional view of FIG. 16 taken along sectional lines 18—18, and depicts the closing of Y-shaped tools 72 and 73 on the first plastic sheet 60, whose portions are separated by blank 78. Note that the tools 72 and 73 perform a thermoplastic welding of the seams. That is, heat from the tools causes the plastic along the seams to be fused together. Although not visible in FIGS. 17 and 18, the upper portions of Y-shaped tools 72 and 73 may simultaneously trim parts of second plastic sheet 70 to form the handle. Again, the edges of the handle 22 are parallel and substantially co-linear with the diagonal edges of the left and right corners of the bag.

It should be noted that the appended drawings are merely representational of the structures and processes used to manufacture bags according to the present invention. The drawings do not reflect accurate dimensions or the exact physics involved in the manufacturing process. These can be readily understood by persons of ordinary skill in the field.

Figure 12:
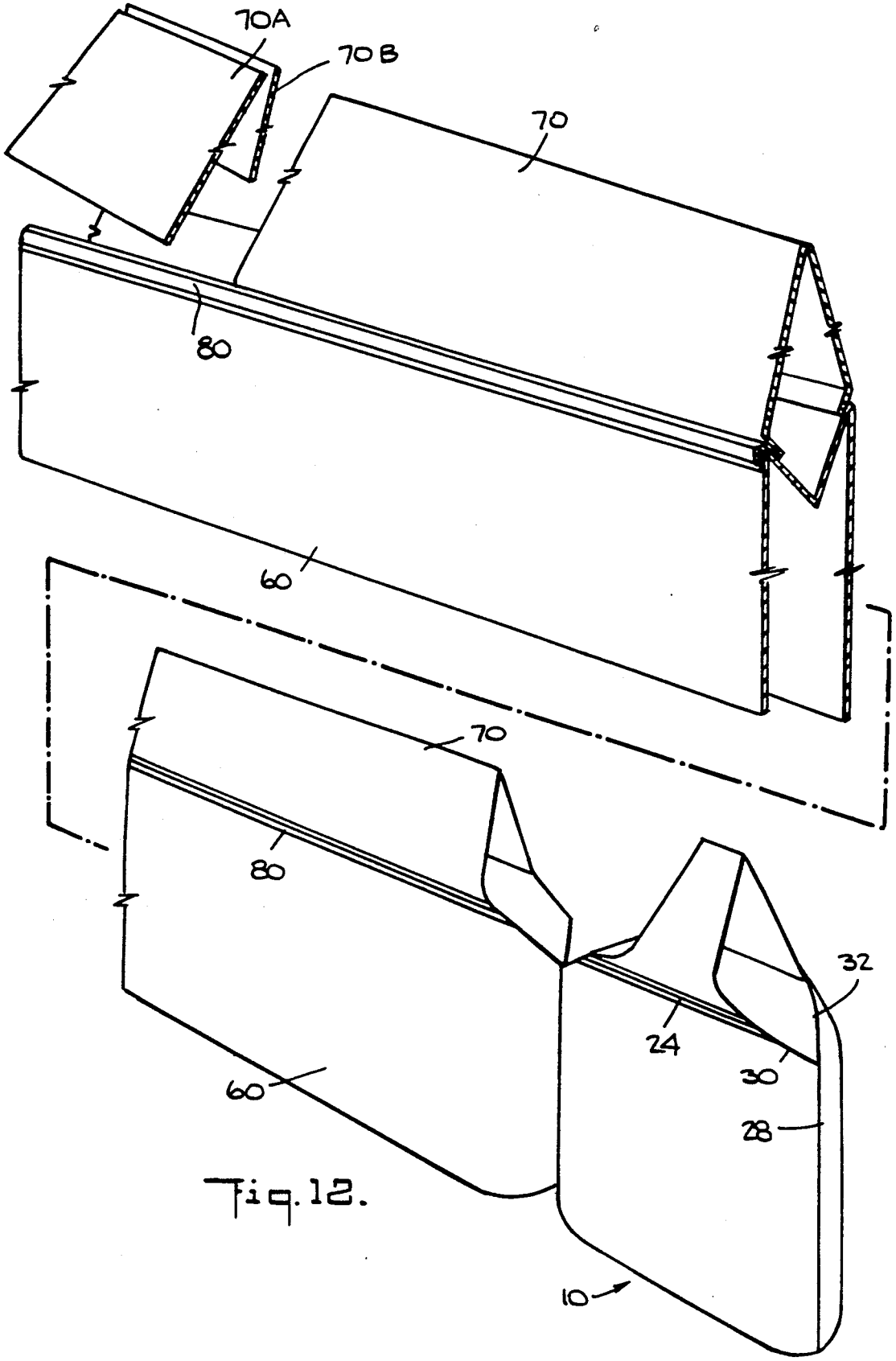
FIG. 12 is a perspective view of a plurality of FIG. 3 bags according to a preferred method of producing such bags.

FIG. 12 is a perspective view, partially in cross-section, depicting the process of producing a plurality of bags according to the FIG. 3 embodiment. Specifically, the handle is sealed to the top of the bag, and a resealable plastic closure is affixed to the bag at the corner of the front wall 12 and the end wall 20. In FIG. 12, a plurality of such bags are produced by folding a continuous thermal plastic sheet 60 over on itself along its longitudinal axis. The M-shaped inward fold 62 is made at the previously folded end. A linearly extending plastic closure strip 80 is placed on plastic sheet 60 at an upper corner of the M-shaped fold. Specifically, the plastic closure strip 80 has two portions, one containing a tongue, and the other containing a groove. Two second continuous sheets of thermal plastic 70A and 70B may be affixed to plastic closure strip 80; and then affixed to sheet 60 and sealed to each other to form sheet 70, which has a seam along its longitudinal axis and is positioned with respect to the first plastic sheet 60 so as to bridge the M-shaped fold 62. As shown in FIG. 3, in this embodiment one portion of the closure strip 80 is sealed to the front wall 12 of the plastic strip 60, while the other portion of the closure strip 80 is sealed to the end wall 20 portion of plastic sheet 60. In this embodiment the closure strip 80 is affixed to plastic sheet 60, and the plastic sheets 70A and 70B may be fixed thereto. Consequently, one edge of plastic sheet 70 is sealed to the top of the portion of plastic closure 80 formed on end wall 20, inside the M-shaped fold 62. The other edge of plastic sheet 70 may be sealed to the other side of end wall 20, as depicted in FIGS. 3 and 12.

After the plastic closure strip 80 and the second plastic sheet 70 are fixed to the first plastic sheet 60 as described above, the cutting and trimming procedure may be carried out to form the plurality of bags, as described above with respect to FIGS. 10, 11 and 13. In this manner, a plurality of bags according to FIG. 3 may be produced in a continuous, high-speed process.

Thus, as described above, a plurality of useful bags having handles may be produced by the processes described above. Each bag will have the characteristic Y-shaped seams, a parallelepiped-structure when filled, and a handle affixed thereto. Those of skill in this field can readily appreciate the substantial manufacturing advantages achieved by the processes described above.

Many alternatives are available in order to successively practice the present invention. For example, bags may be produced which have Y-shaped seams at both ends of the bag. Specifically, both a bag top and a bag bottom may be constructed so that they are substantially cubic or parallelepiped when filled, yet require very little plastic in order to form the seams. In this event, two edges of a first plastic sheet are sealed together to form a tube and two M-shaped folds are placed on opposing sides of the tube. Y-shaped tools 72 and 73 will also have angled Y-shaped extending portions at the bottom thereof. Diagonal lines will be formed at left and right corner portions of adjacent bags at both the tops and bottoms thereof. In this event, the handle 22 and closure 24 may be located at any convenient location along either M-fold as required by the user. One end or a side of the bag may remain unsealed for later filling.

In addition, many structures may be adapted for providing openings in bags according to the present invention. Such alternative structures include but are not limited to: single or multiple lines of perforations on end wall 20, and/or the front and rear walls 12, 14; a selection of plastic material which is frangible by its nature allowing access in any portion of the bag; the tongue-in-groove structure described above with a line of perforations in the bag immediately beneath the opening; a circular or half-moon line of perforations; fold-out pouring spouts; tear-away corners or strips; built-in pouring valves; and other known and convenient structures. All such structures are considered protected by the scope of the appended claims.

Thus, what has been described above is a plastic bag with a handle and characteristic Y-shaped seams which allow the bag to assume a parallelepiped-like shape when filled. The seams are formed so that the adjacent plastic portions are substantially co-planar with substantially no plastic overlap or tucks at the seams. The handles are efficiently trimmed to provide an attractive bag with handles that function to maintain and enhance the smooth, block or cubic shape of the bag. The bag allows the maximum amount of product with the minimum volume requirements for such a product and bag combination. A resealable plastic closure or perforations may be formed in the bag in order to facilitate access, and the opening has good pouring characteristics. The method of producing a plurality of such bags may be arranged to fold, position, and simultaneously cut and trim the plastic sheets to produce efficiently a plurality of bags as described above.

While the present invention has been described with what are presently considered to be the most practical and preferred embodiments and method, the invention is not limited to the disclosed embodiments or processes.

What is claimed is:

1. A bag having a handle, comprising:

a front, a rear, and an end wall of flexible plastic;

left and right side walls of flexible plastic, each side wall having a Y-shaped seam which comprises a base portion and two arm portions, the base portion of each seam joining together plastic from the front and rear walls, one arm portion of each seam joining together plastic from the front wall and the end wall, and the other arm portion of each seam joining together plastic from the rear wall and the end wall; and a flexible plastic handle spanning at least a portion of the end wall and extending from an arm portion of a seam on one side wall to an arm portion of a seam on the other side wall, said handle being bonded to each of said front and rear walls.

2. A bag according to claim 1, wherein all portions of the flexible plastic which are joined at the seams are substantially coplanar without substantial plastic overlap.

3. A bag according to claim 1, further comprising flexible plastic closure means having a portion fixed to said front wall and another portion fixed to said end wall.

4. A bag according to claim 1, further comprising a line of perforations in one of said front wall and said end wall extending perpendicular to a longitudinal axis of said handle.

5. A bag according to claim 1, further comprising a curvilinear line of perforations in one of said front wall and said end wall.

6. A bag according to claim 1, wherein said flexible plastic handle is coupled to upper portions of the front and the said rear walls.

7. A bag according to claim 1, wherein said flexible plastic handle is coupled to a surface of the end wall.

8. A flexible plastic bag comprising:

a plastic sheet folded over upon itself at a bag first end with an inward fold at the first-mentioned fold to create two exterior surfaces and an inwardly folded portion of the sheet;

a diagonal edge at a left or a right portion of the bag first end, the diagonal edge having first and second seams connecting the respective bag exterior surfaces to opposing edges of the inwardly folded portion of the sheet;

a side seam connecting together opposing edges of the two exterior surfaces and being contiguous with the first and second seams of the diagonal edge; and a flexible plastic handle connected to said bag, spanning at least a portion of the inward fold, and being contiguous with the first and second means of the diagonal edge, said handle being bonded substantially across faces of the two exterior surfaces.

9. A bag according to claim 8, further comprising a temporarily closable opening fixed to the inwardly folded portion and an exterior surface of said plastic sheet.

10. A plastic structure for use as a bag having a handle, comprising:

a sheet of flexible plastic having a M-shaped fold therein and left and right side edges, left and right corners of the folded sheet having been removed on a diagonal from an interior fold of said M-shaped fold toward the left and right side edges, the diagonal at each corner slanting toward the other, and the left and right side edges being affixed to opposing portions of the sheet and its corners; and a web handle of flexible plastic welded substantially across two faces of said plastic sheet between the two diagonally removed corners.

11. A plurality of structures for use as bags with handles manufacturable by high speed automated machinery from two extended sheets of flexible thermal plastic comprising a plurality of upper and lower trapezoidal shaped pieces of flexible plastic sheets manufactured from a single extended sheet of thermal plastic, each integral at its shorter parallel side with a hexagonal piece of flexible plastic sheet and at its larger parallel side with upper and lower rectangular pieces of flexible plastic respectively, side edges of the upper and lower rectangular pieces of plastic being affixed to each other, and the diagonal edges of the trapezoidal shaped pieces being affixed to the hexagonal piece, and handles of the bags manufactured from a single extended sheet of thermal plastic extendings across at least a portion of the hexagonal piece and between the diagonal edges, the handle being bonded substantially across a face of each of the trapezoidal shaped pieces adjacent the shorter parallel side.

12. A structure according to claim 11 in which the handle is bonded to the rest of the structure at or near a junction of the shorter parallel sides of the trapezoidal shaped pieces and the hexagonal piece.

* * * * *

UNITED STATES PATENT AND TRADEMARK OFFICE

CERTIFICATE OF CORRECTION

PATENT NO. : 5,080,497

DATED : January 14, 1992

INVENTOR(S) : Harry R. PEPPIATT

It is certified that error appears in the above-identified patent and that said Letters Patent is hereby corrected as shown below:

COLUMN 4:
Line 2, "generally" should be deleted.

COLUMN 5:
Line 52, "VELCRO TM (TM)," should read --VELCRO (Tm),--.

COLUMN 7:
Line 63, "FIG. 1" should read --FIG. 10--.

COLUMN 8:
Line 61, "bag e.g." should read --bag, e.g.--.

COLUMN 12:
Line 24, "first and second means" should read --first and second seams--; and
Line 59, "extendings" should read --extending--.

Signed and Sealed this

Sixth Day of July, 1993

Michael K. Kirk

*Attest:*

MICHAEL K. KIRK

*Attesting Officer*

*Acting Commissioner of Patents and Trademarks*